US006071127A

United States Patent [19]

Acke et al.

[11] Patent Number: 6,071,127

[45] Date of Patent: Jun. 6, 2000

[54] HF COAXIAL CONNECTOR HAVING A PLUG MODULE AND A SOCKET MODULE

[75] Inventors: Edgard Acke, Oostkamp; Reginald Leeman, Ostend; Bernard Houtteman, Oostkamp, all of Belgium

[73] Assignee: Siemens Aktiengesellschaft, Munich, Germany

[21] Appl. No.: 09/030,405

[22] Filed: Feb. 25, 1998

[30] Foreign Application Priority Data

Feb. 25, 1997 [DE] Germany ..... 197 07 490

[51] Int. Cl.[7] ..... H01R 12/00

[52] U.S. Cl. ..... 439/63; 439/581; 439/63

[58] Field of Search ..... 439/63, 581

[56] References Cited

U.S. PATENT DOCUMENTS 5,169,343 12/1992 Andrews ..... 439/608
5,344,340 9/1994 Bouleau ..... 439/581
5,516,307 5/1996 Cartesse et al. ..... 439/63
5,718,592 2/1998 Hosler, Sr. et al. ..... 439/63
5,842,872 12/1998 Hosler, Sr. et al. ..... 439/63

FOREIGN PATENT DOCUMENTS

0582960A1 2/1994 European Pat. Off. .

*Primary Examiner*—Renee S. Luebke
*Assistant Examiner*—T. C. Patel
*Attorney, Agent, or Firm*—Herbert L. Lerner; Laurence A. Greenberg; Werner H. Stemer

[57] ABSTRACT

An HF coaxial plug connector includes coaxial plugs disposed in a multiple plug housing-coaxial plug module, and coaxial sockets disposed in a multiple socket housing-coaxial socket module for use in circuits, especially in printed circuit board technology. Coaxial outer conductors of the coaxial socket module are at least partly integrated with its housing in the form of sheaths which act as coaxial outer conductors and extend in the housing toward its insertion side for the coaxial plug module. Insulating plastic sheaths which are inserted into these thus-created coaxial outer conductors, receive coaxial inner conductors therein.

24 Claims, 7 Drawing Sheets

1
7
10
13
9
9
5
12
SEE 3
13
12

2
4
13
12
17
18
11
14
16
17
8
20
15
19
16
8
11
6
14

HF COAXIAL CONNECTOR HAVING A PLUG MODULE AND A SOCKET MODULE

BACKGROUND OF THE INVENTION

1. Field of the Invention

Circuits for high-frequency electromagnetic waves require coaxial plug connectors, which must have practically no abrupt changes in wave resistance within a line segment that they represent, in order to provide effective transmission of electromagnetic energy. In the currently conventional realization of such circuits in printed circuit board technology, multiple coaxial plug connectors, and specifically coaxial plug connectors and angled coaxial plug connectors in a high packing density, are employed. Their electrical connection to the printed circuit board is carried out through the use of terminal pins that can be press-fitted into the printed circuit board.

The invention relates to an HF coaxial plug connector, including coaxial plugs disposed in a multiple plug housing-coaxial plug module, coaxial sockets disposed in a multiple socket housing-coaxial socket module, the coaxial plug module and the coaxial socket module each secured to a base, for instance a printed circuit board and, in a state in which they are secured to the base, make a conductive connection, through the use of terminal pins thereof connected to the coaxial conductors at the bottom, with terminals associated with them on the base, coaxial inner conductors of the coaxial plug module having bottom terminal pins each disposed and insulated in bores in its housing acting as coaxial outer conductors, coaxial inner conductors of the coaxial socket module having bottom terminal pins disposed and insulated against respective coaxial outer conductors in receiving openings of its housing, and the coaxial socket module and the coaxial plug module having the same number of coaxial plugs and coaxial sockets in the same configuration, as well as a device for mutual centering thereof on sides where they connect.

Known HF coaxial plug connectors, as disclosed, for instance, in U.S. Pat. No. 5,169,343, require especially high production technology, effort and expense, if the coaxial plug connector is to have adequate flexibility in terms of the number of its coaxial terminals.

As U.S. Pat. No. 5,169,343 clearly shows with the aid of its drawings, the housings of the coaxial plug module and coaxial socket module are each constructed to receive six coaxial plugs and coaxial sockets, respectively, which are combined in pairs into subsidiary plugs and can be inserted into their housings. In this way it is possible to equip the housings of the coaxial plug module and coaxial socket module with two, four or six associated coaxial plugs and coaxial sockets, depending on the need and the particular application. The major production technology expense for such coaxial plug connectors is due to the unavoidable play which is needed for assembly, between the subsidiary plugs to be inserted into the housings, the attendant eccentricity of the coaxial plug view relative to the theoretical center, and impermissible skewed positions of coaxial plugs and/or coaxial sockets upon being press-fitted into receiving openings on the housing or the subsidiary plug. In this case in order to avoid impermissible incremental lengths in the positional tolerances, only very close tolerances can be allowed in the production of the individual components, leading to correspondingly high production costs.

As is shown by another reference, European Patent Application 0 582 960 A1, the aforementioned production cost of such coaxial plug connectors for the coaxial plug module can be substantially reduced by integrating the coaxial plugs with a housing of conductive material, in the form of a monoblock. The monoblock forms the coaxial outer conductors in the form of bores. Insulating plastic sheaths are inserted into those bores and the coaxial inner conductors are retained within the insulating plastic sheaths. Conversely, in the coaxial socket module, the coaxial sockets are press-fitted into receiving openings of a housing that is degenerated to form a base plate. Once again, the aforementioned problems in terms of the incremental length of the positional tolerances arise. The coaxial plug connector which is known from that last reference has the further advantage, over the coaxial plug connector known from U.S. Pat. No. 5,169,343, that the coaxial plug module and coaxial socket module can be equipped selectively for 1, 2, 3, 4, 5 or 6 coaxial plug connectors. In other words, the quantitative versatility is not merely two but one.

SUMMARY OF THE INVENTION

It is accordingly an object of the invention to provide an HF coaxial plug connector, specifically for a coaxial socket module, which overcomes the hereinafore-mentioned disadvantages of the heretofore-known devices of this general type and which makes fewer demands in terms of production variations and therefore can be produced more economically.

With the foregoing and other objects in view there is provided, in accordance with the invention, an HF coaxial plug connector, comprising a coaxial plug-coaxial plug module including a multiple plug housing having bores acting as coaxial outer conductors, and coaxial inner conductors having bottom terminal pins disposed and insulated in the bores; a coaxial socket-coaxial socket module including a multiple socket housing having an insertion side for the coaxial plug module, sheaths extended in the housing toward the insertion side, the sheaths having receiving openings and a tubular foot part with a widened outer diameter, preferably in a stepped manner, conductive coaxial outer conductors at least partially integrated with the housing, insulating plastic sheaths inserted into the coaxial outer conductors, and coaxial inner conductors disposed in the insulating plastic sheaths and having bottom terminal pins disposed in the receiving openings and insulated against the coaxial outer conductors; the coaxial socket module and the coaxial plug module having an equal number of coaxial plugs and coaxial sockets in the same configuration, connecting sides, and a device for mutual centering on the connecting sides; and each of the coaxial plug module and the coaxial socket module to be secured to a base, for instance a printed circuit board, for making a conductive connection between the terminal pins and associated terminals on the base.

The invention is based on the recognition that in a way similar to the monoblock structure for the housing of the coaxial plug module, in the coaxial plug connector of European Patent Application 0 582 960 A1, the coaxial outer conductors can be integrated into the housing in the housing of the coaxial socket module as well by providing that its receiving openings for the coaxial sockets are elongated to form conductive sheaths on the housing that are able to assume the function of coaxial outer conductors for the coaxial sockets.

In accordance with another feature of the invention, the sheaths acting as conductive coaxial outer conductors of the coaxial socket module have a transition to the tubular foot part, a free end surface with an outside, slits extending in axial direction from the free end surface to the vicinity of the transition upon complete integration into the housing, and contact beads on the outside of the free end surface.

In accordance with a further feature of the invention, the sheaths acting as conductive coaxial outer conductors of the coaxial socket module have an outside, a free end surface, and a metal spring ring with contact beads on the outside, the ring slipped onto the free end surface and connected firmly upon partial integration with the housing.

In accordance with an added feature of the invention, the sheaths acting as conductive coaxial outer conductors of the coaxial socket module use the tubular foot part upon partial integration with the housing and have a free end with a surface, an actual plug part between the free end and the tubular foot part, a metal outer conductor tube pressed onto the insulating plastic sheath, and axial slits on the free end surface forming a radial spring crown; the radial spring crown has spring blades with free ends having an outside and contact beads on the outside of the free ends; and the insulating plastic sheaths receiving the coaxial inner conductors are inserted together with the metal outer conductor tubes pressed thereon into the tubular foot parts.

In accordance with an additional feature of the invention, the sheaths of the housing in the coaxial socket module acting as conductive coaxial outer conductors have a tubular inside diameter offset at least once in a stepped manner, and the insulating plastic sheaths to be inserted therein have a tubular outside diameter offset at least once in a stepped manner, in each case along their length, forming annular edges acting as mutually associated stops for the insulating plastic sheaths to be thrust into the sheaths until meeting a stop.

In accordance with yet another feature of the invention, the housing of the coaxial plug module is an angled coaxial plug connector part or a straight coaxial plug connector part.

In accordance with yet a further feature of the invention, the housing of the coaxial socket module is a straight coaxial plug connector part or an angled coaxial plug connector part.

In accordance with yet an added feature of the invention, the terminal pins in the bottom of the housing for the coaxial outer conductors of the coaxial plug module and the coaxial socket module are press-fitted individually into conductive holes in a wall or secured multiply to ground strips and press-fitted into conductive slots in a wall.

In accordance with yet an additional feature of the invention, the coaxial plug module is an angled coaxial plug connector part, the housing of the coaxial plug module has striplike openings in a back wall for mounting the angled coaxial inner conductors, and a common cap closes the openings.

In accordance with again another feature of the invention, the bores acting as coaxial outer conductors in the housing of the coaxial plug module have at least one inner annular edge, the insulating plastic sheaths receiving the coaxial inner conductors have at least one outer annular edge and are thrust from a front side into the bores until meeting a stop, and the angled coaxial inner conductors are thrust into the insulating plastic sheaths from a rear side.

In accordance with again a further feature of the invention, the bores acting as the coaxial outer conductors in the housing of the coaxial plug module are metal outer conductor tubes in an insertion region of the coaxial plugs, the tubes are inserted from a front side into the bores until meeting a stop, and the bores have a widened diameter therefor in the insertion region.

In accordance with again an added feature of the invention, the terminal pins of the coaxial plug module and of the coaxial socket module have press-fit contact heads.

In accordance with again an additional feature of the invention, the housings of the coaxial plug module and the coaxial socket module are plastic housings at least partially having a metallizing, and the metallizing has a layer thickness at least equal to a depth of penetration of electromagnetic waves to be transmitted through the coaxial plug connector.

In accordance with still another feature of the invention, the housings of the coaxial plug module and the coaxial socket module have an outer wall with at least one groove having an opening and a center rib in the groove acting as a separation lug and not protruding past the opening of the groove; the coaxial plug module and the coaxial socket module match one another and the at least one groove is disposed between two respective columns or lines of the coaxial plugs and coaxial sockets disposed in a pattern of columns and lines; and a severing created by the groove on the housing of the conductive connection between the coaxial outer conductors of the coaxial plug module and the coaxial socket module is brought about by breaking away the center rib in the groove.

In accordance with still a further feature of the invention, at least one of the plastic housing of the coaxial plug module and the plastic housing of the coaxial socket module is completely metallized, and the at least one groove with the center rib in the outer wall of at least one of the housing of the coaxial plug module and the housing of the coaxial socket module annularly encompasses at least one of the housings.

In accordance with still an added feature of the invention, at least one of the plastic housing of the coaxial plug module and the plastic housing of the coaxial socket module is covered completely with a metallizing, the metallizing of the housing is present essentially to an extent necessary for electrically conductive properties of the sheaths including the terminal pins in the housing of the coaxial socket module and the bores including the terminal pins in the housing of the coaxial plug module.

In accordance with still an additional feature of the invention, the severing of the conductive connection between the coaxial outer conductors of the coaxial plugs and coaxial sockets, disposed in a pattern of columns and lines, of the respective coaxial plug module and coaxial socket module, is effected by partial linear removal of the metallizing on the housing, given a matching configuration on the coaxial plug module and the coaxial socket module, between two columns or two lines of the coaxial plugs or coaxial sockets, for instance by laser machining.

In accordance with a concomitant feature of the invention, the housings of the coaxial plug module and the coaxial socket module are metal housings of die-cast metal, for instance die-cast zinc.

Other features which are considered as characteristic for the invention are set forth in the appended claims.

Although the invention is illustrated and described herein as embodied in an HF coaxial plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figures 1, 1A, 2:
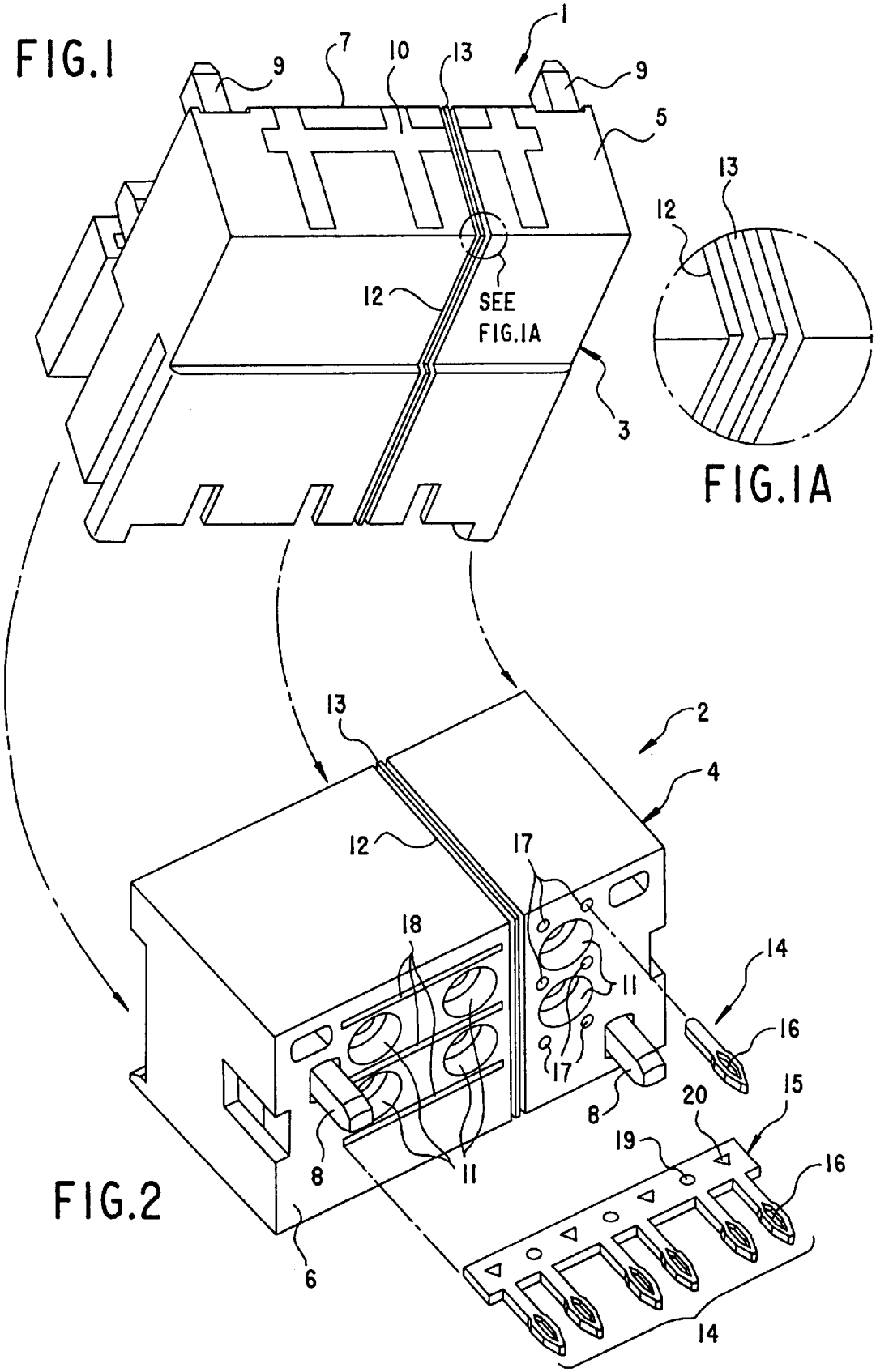
FIGS. 1 and 2 are diagrammatic, perspective views of a coaxial plug connector, including a coaxial plug module and a coaxial socket module, with fully metallized plastic housings.
FIG. 1*a* is an enlarged, fragmentary, perspective view of a portion Ia of FIG. 1.

Referring now to the figures of the drawings in detail, there is seen an exemplary embodiment of a coaxial plug connector with six coaxial plug connectors, in which FIG. 1 shows a coaxial plug module 1 in the form of an angled coaxial plug connector part, and FIG. 2 shows a coaxial socket module 2 in the form of a straight coaxial plug connector part. A housing 3 of the coaxial plug module 1 and a housing 4 of the coaxial socket module 2 may intrinsically be metal housings, for instance made of die-cast zinc. However, in the exemplary embodiments shown in the drawings, the housings 3 and 4 are either fully or only partially metallized plastic housings. A layer thickness of the metallizing is at least equal to a penetration depth of electromagnetic waves to be transmitted through the coaxial plug connectors. In the illustration of the coaxial plug module 1 in FIG. 1 and of the coaxial socket module 2 in FIG. 2, the housings 3 and 4 are fully metallized. Coaxial inner conductors have not yet been inserted into coaxial outer conductors of the housings 3 and 4. The coaxial outer conductors are not visible in FIG. 1, but they are suggested there by a striplike cap 10 inserted into a back wall 5 and in FIG. 2 they are suggested by receiving openings 11 that are visible in a bottom 6.

The six coaxial plug connectors of the two modules are disposed on the housings in a pattern of columns and lines with three columns and two lines, as is shown especially well at the bottom 6 of the housing 4 of the coaxial socket module 2 in FIG. 2, with its six receiving openings 11 for receiving the coaxial inner conductors. Centering pins 8 and 9 respectively protrude from the bottom 6 of the coaxial socket module 2 and a bottom 7 of the coaxial plug module 1 and when they are placed on a base, preferably a printed circuit board, they engage recesses associated with them there. These bases are not shown in FIGS. 1 and 2 nor in the other drawings.

Due to the surface-covering metallizing of the housings 3 and 4, all of the coaxial outer conductors of the coaxial plug module on one hand and of the coaxial socket module 2 on the other hand are electrically conductively connected to one another. As a rule, this is desirable, since the potential of the coaxial outer conductors is typically at ground. For instance, if the two coaxial outer conductors represented by their receiving openings 11 on the right can be separated as needed in terms of potential from the other four coaxial outer conductors, on one hand in the coaxial socket module 2 and on the other hand in the coaxial plug module 1, depending on the production and metallizing of the housings 3 and 4, then in principle there are two possible ways to do this.

One possibility is to impress a groove 12, with a center rib 13 acting as a separation lug, into the wall of the housing when the housings 3 and 4 are made. FIG. 1*a* shows a portion of the groove 12 including its center rib 13 on a larger scale. The groove 12 with its center rib 13 encompasses the housing 3 and the housing 4 between the two coaxial outer conductors on the right and the four coaxial outer conductors on the left in the housings 3 and 4 of the coaxial plug connector. The center rib 13 should not protrude past the upper edge of the groove 12. The already-described potential separation between the coaxial outer conductors for the coaxial plug module 1 and the coaxial socket module 2 can be brought about retroactively at any time as needed by breaking away the center rib 13, since the rated breaking point of the center rib 13 is not metallized.

The groove 12 in the housing shown in FIGS. 1 and 2, with its center rib 13, can also be shifted to the left, for instance, on the housings 3 and 4, so that a retroactive potential separation of the two coaxial outer conductors on the left from the other four coaxial outer conductors on the right can be brought about therewith. A groove 12 which is disposed in the housing, has a center rib 13, extends perpendicular to the direction shown in FIGS. 1 and 2 and is located between each two lines of three coaxial outer conductors around the housings 3 and 4, enables a retroactive potential separation between the three upper and the three lower coaxial outer conductors. If three grooves 12 with a center rib 13 are disposed on the housing, or in other words if such grooves are disposed multiply on the housing, then the potentials of all six coaxial outer conductors can be separated from one another retroactively as needed.

The other possibility for retroactive potential separation provides for partially removing the metallizing annularly, for instance by laser machining, instead of providing one or more grooves 12 with a center rib 13 that can be broken out between the coaxial outer conductors on the periphery of the housings 3 and 4. Naturally, both possibilities can also be employed simultaneously for a retroactive potential separation. Noting once again that the coaxial outer conductors are suggested in FIG. 2 by the six receiving openings 11 for the coaxial inner conductors in the bottom 6 of the housing 4, the electrically conductive connection of the coaxial outer conductors of the coaxial plug module 1 and the coaxial socket module 2 is made through the use of terminal pins 14, which are used in this case by being secured individually or multiply to ground strips 15. The terminal pins 14 are provided with press-fit contact heads 16 for their electrically conductive connection with terminals associated with them on a base or a printed circuit board. Individual terminal pins 14 are inserted into metallized holes 17 in the bottom wall 6, where they are retained in a press fit. Metallized wall slots 18 are provided in the bottom 6 in order to secure the terminal pins that are secured to the ground strips 15. A firm seat of the ground strips 15 in the wall slots 18 is assured by dimple-like recesses 19 and locking hooks 20 that are attached to the ground strips 15. The choice and disposition of the wall holes 17 and the wall slots 18 in the bottom 6 for securing the terminal pins 14 depends, as FIG. 2 shows, on what possibilities for retroactive potential separation between the coaxial outer conductors of the coaxial plug module 1 and the coaxial socket module 2 are to be provided.

It will also be noted herein, merely for the sake of completeness, that in the coaxial plug module 1 of FIG. 1, the terminal pins 14 are secured individually or multiply in conjunction with the ground strips 15 to its bottom 7, in the same way as they are secured to the bottom 6 of the coaxial socket module 2 of FIG. 2.

Figure 3:
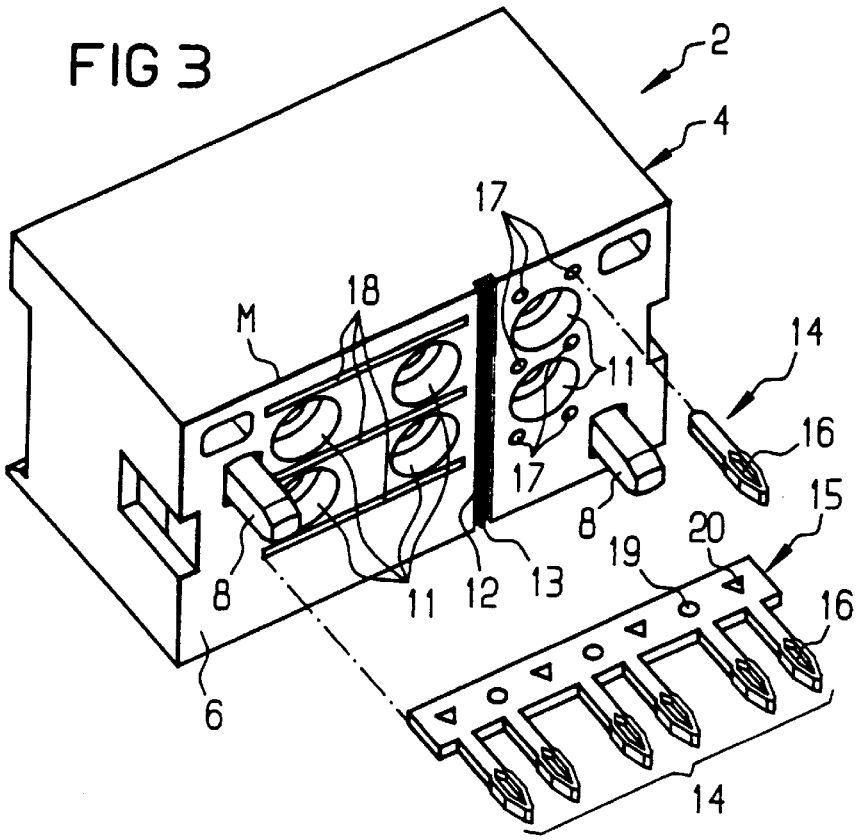
FIG. 3 is a perspective view of a coaxial socket module corresponding to FIG. 2 and having a plastic housing which is only partially metallized in a first manner.

In a distinction from FIG. 2, in the housing 4 of the coaxial socket module 2 shown in FIG. 3, only the bottom 6 is provided on its outside with a metallizing M. This only partially provided metallizing M accordingly also extends to the receiving openings 11 and to the inner wall of the coaxial outer conductors that are integrated with the housing 4 and that will be described in further detail in regard to FIGS. 5–10. Therefore, in order to provide a retroactive potential separation as in FIG. 2, the groove 12 with the center rib need not be provided annularly around the circumference of the housing 4 in this case but only on the outside of the bottom 6. A corresponding partial metalization may also be provided for the housing 3 of the coaxial plug module 1.

The partial metallizing of the housing 4 of the coaxial socket module in FIG. 3 can be carried out even further, since the outside of the bottom 6 of the housing 4 after all need merely be provided with a metallizing M around the receiving openings 11 to the extent necessary for contact with the terminal pins 14. Arbitrary desired potential separations among the coaxial outer conductors can then be taken into account at the same time. In the coaxial socket module 2 shown in FIG. 4, three metallizings M, which are each defined in terms of surface area over two receiving openings 11 for two coaxial outer conductors, are provided on the bottom 6 of the housing 4, and a potential separation is brought about through the use thereof in such a way that the coaxial socket module 2 has three independent pairs of coaxial outer conductors. The coaxial plug module 1 can be partially metallized in a corresponding way.

Figure 4:
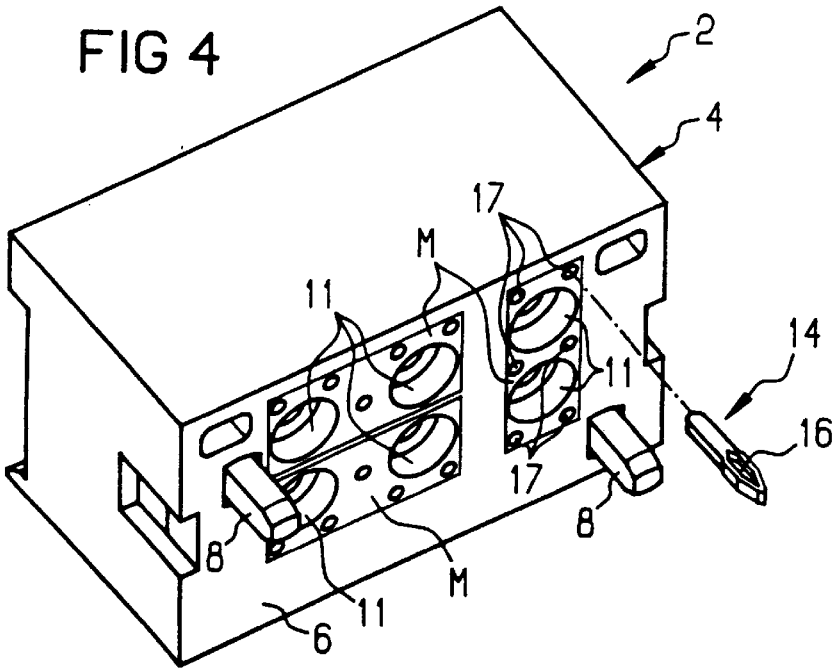
FIG. 4 is a perspective view of a coaxial socket module corresponding to FIG. 2 and having a plastic housing that is only partially metallized in a second manner.
Figure 6:
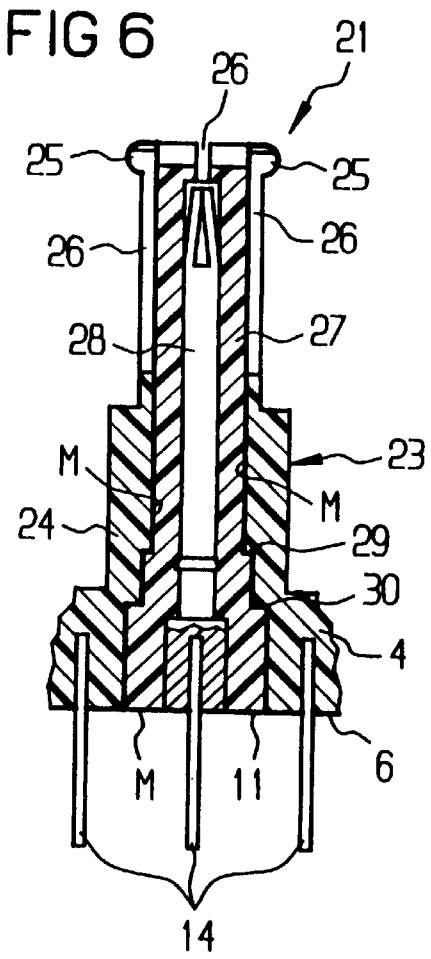
FIG. 6 is an enlarged, sectional view of a coaxial socket of the coaxial socket module of FIG. 5.
Figure 5:
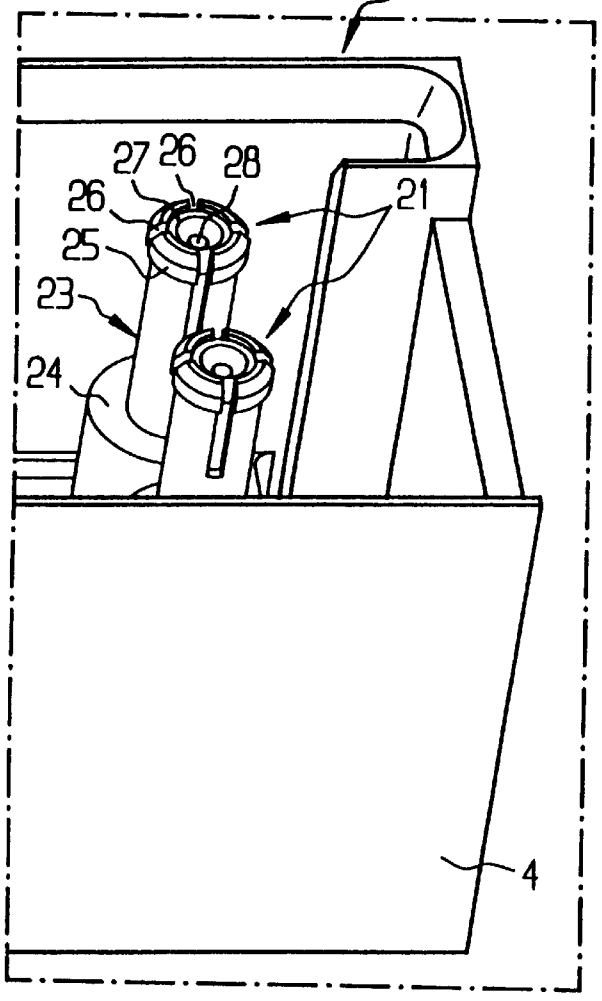
FIG. 5 is a fragmentary, perspective view of a coaxial socket module of one of FIGS. 2–4 in a first preferred embodiment with coaxial sockets having coaxial outer conductors that are fully integrated with the housing of the coaxial socket module.

FIG. 5 shows a portion of a coaxial socket module 2 of FIGS. 2–4, which allows one to look into the housing 4 with its coaxial sockets 21 from an insertion side 22, and in which the coaxial outer conductors are fully integrated with the housing 4. As the sectional view of one of the coaxial sockets 21 in FIG. 6 shows, the coaxial outer conductors are sheaths 23 on the housing, which are part of the bottom 6 of the housing 4 and extend from their receiving opening 11 in the bottom 6 into the housing 4 as far as its insertion side 22. The sheaths 23 have a foot part 24 which is widened in a stepped manner and they are provided with contact beads 25 on the outside of their free end surface. In order to achieve the coaxial outer conductor function of the sheaths 23, at least their inner walls, including their contact beads 25, must be provided with a metallizing M. In order to allow the contact beads 25 to have radially yielding properties, the sheaths 23 have axial slits 26, which extend from their free end surface into the vicinity of their transition to the tubular foot part 24.

Insulating plastic sheaths 27 are inserted into the metallized sheaths 23 and receive metal coaxial inner conductors 28 inside them. The sheaths 23 are offset twice in a stepped manner in their tubular inside diameter. In the same way, the plastic sheaths 27 are offset twice in their outer diameter. On one hand, these diameter offsets serve the purpose of adapting the wave resistance of the coaxial sockets 21. On the other hand, the annular edges created by these diameter offsets form stops 29 and 30, associated with one another, for the plastic sheaths 27 that are to be inserted into the sheaths 23 until they meet a stop. In order to provide a conductive connection of the coaxial inner conductors 28 with a terminal on the base associated therewith, the coaxial inner conductor 28 likewise merges at the bottom 6 of the housing 4 with a terminal pin 14, which is press-fitted or soldered into the end surface of the coaxial inner conductor 28 on the bottom 6 of the housing 4.

Figure 8:
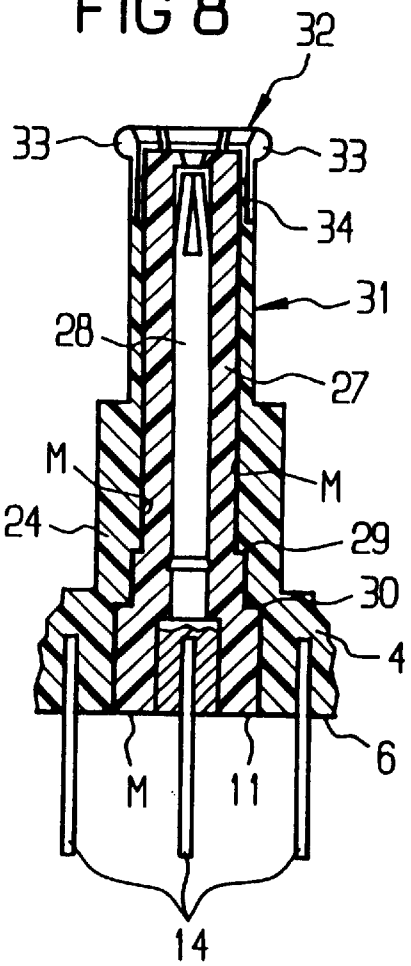
FIG. 8 is a sectional view of a coaxial socket of the coaxial socket module of FIG. 7.
Figure 7:
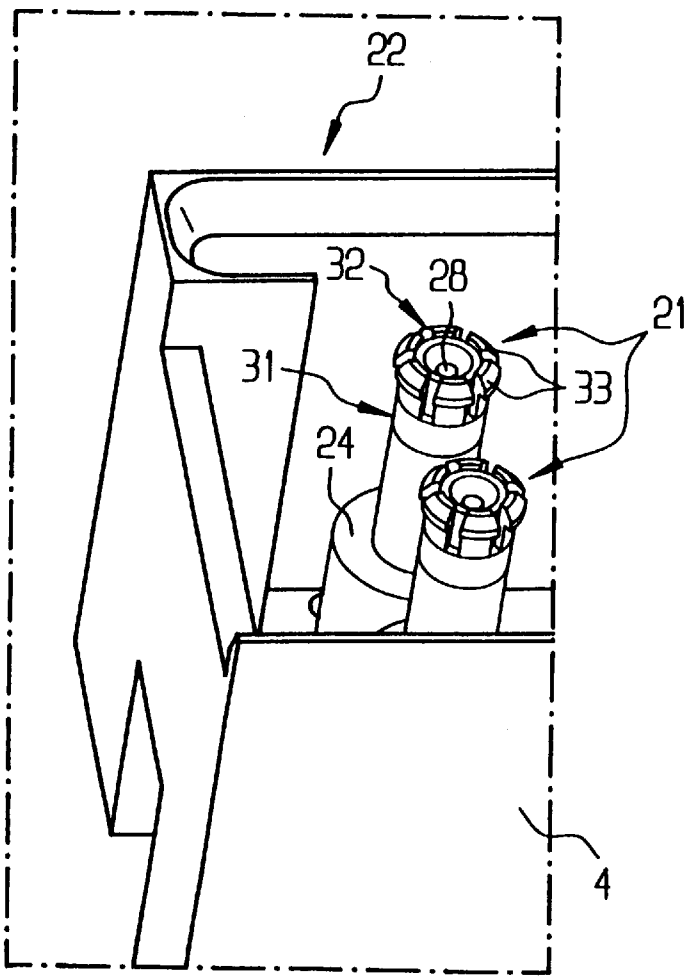
FIG. 7 is a fragmentary, perspective view of the coaxial socket module of one of FIGS. 2–4 in a second preferred embodiment with coaxial sockets having coaxial outer conductors which are partially integrated with the housing of the coaxial socket module in a first manner.

If more stringent demands in terms of plug properties are made, then it is appropriate to only partially carry out the integration of the coaxial outer conductors with the housing 4. A first exemplary embodiment thereof is shown by FIGS. 7 and 8, which correspond to FIGS. 5 and 6. Sheaths 31 of the housing that act as coaxial outer conductors in this case have no axial slits but instead are crowned with a metal spring ring 32. The spring ring 32 has radially yielding contact beads 33 on the outside and is slipped onto an end surface 34 of the sheaths 31, with the end being offset in a stepped manner in its outer diameter. In order to achieve their coaxial outer conductor function, at least the inner walls as well as the end surfaces 34 of the sheaths 31 that are offset in a stepped manner must be provided with a metallizing M.

Figure 10:
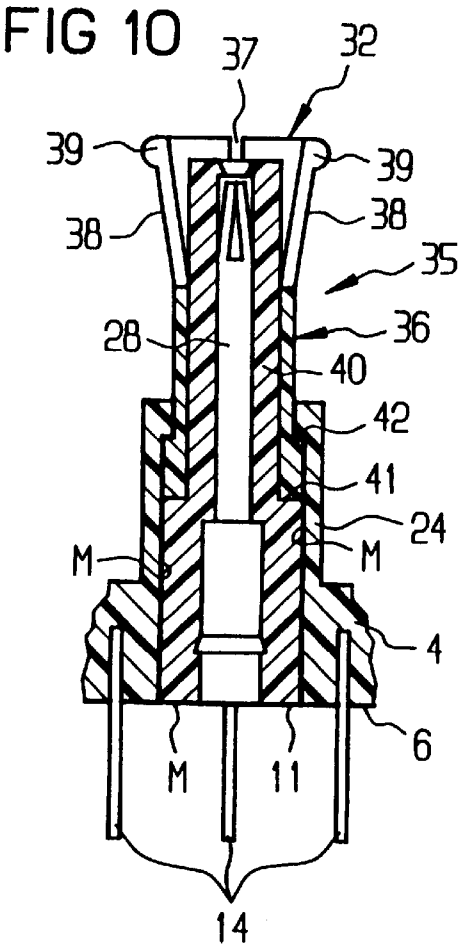
FIG. 10 is a sectional view of a coaxial socket of the coaxial socket module of FIG. 9.
Figure 9:
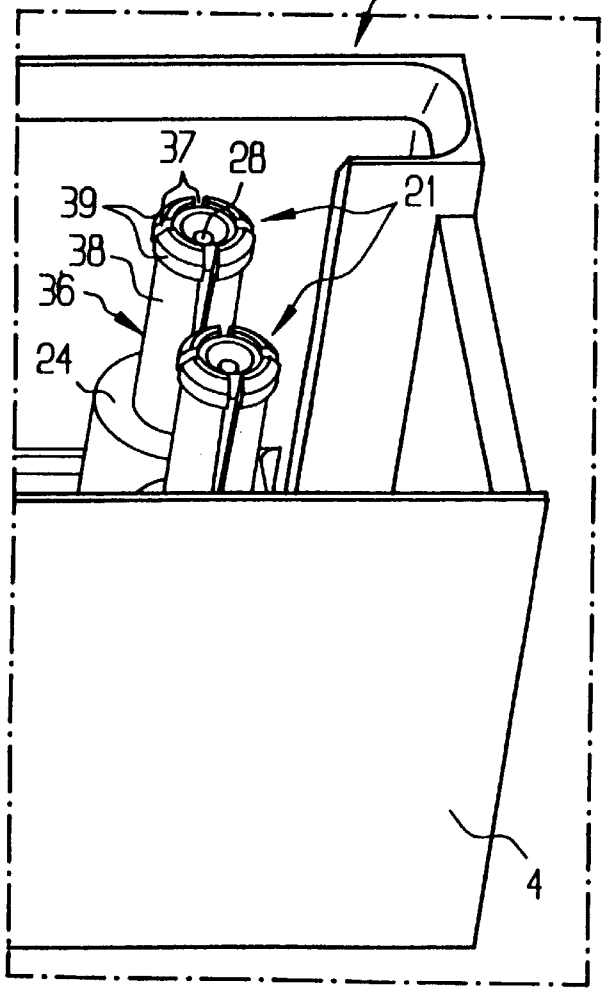
FIG. 9 is a fragmentary, perspective view of the coaxial socket module of one of FIGS. 2–4 in a third preferred embodiment with coaxial sockets having coaxial outer conductors that are partially integrated with the housing of the coaxial socket module in a second manner.

A second exemplary embodiment of a partial integration of the coaxial outer conductors is shown in FIGS. 9 and 10, which correspond to FIGS. 7 and 8. In a distinction from FIGS. 7 and 8, an actual insertion or plug-in part of sheaths 35, between their free end surface and their tubular foot part 24, includes a metal outer conductor tube 36. The metal outer conductor tube 36 is divided on the free end surface of the sheaths 35 by axial slits 37 to form radial spring blades 38, which are provided with contact beads 39 on the outside of their free ends.

The metal outer conductor tube 36 is thrust onto an insulating plastic sheath 40 up to a stop 41. This plastic sheath 40 receives the coaxial inner conductors 28 within itself, and the metal outer conductor tube 36 is firmly anchored in a press fit on the plastic sheath 40. The stop 41 of the plastic sheath 40 is realized in the region of the tubular foot part 24, because of its stepwise-offset outer diameter. In this case as well, the insulating plastic sheath 40 is thrust, with the metal outer conductor tube 36 slipped onto it, into the tubular foot part 24 until it meets the stop 42. The stop 42 is obtained on one hand by the stepped offset tubular inside diameter of the tubular foot part 24 and on the other hand by the likewise stepped offset tubular outer diameter of the metal outer conductor tube 36. In order to enable the metal outer conductor tube 36 to achieve the desired coaxial outer conductor function, at least the inner wall of the tubular foot part 24 must have a metallizing M, specifically continuously as far as the metallizing M on the outside of the bottom 6 of the housing 4 having the terminal pins 14.

Figure 11:
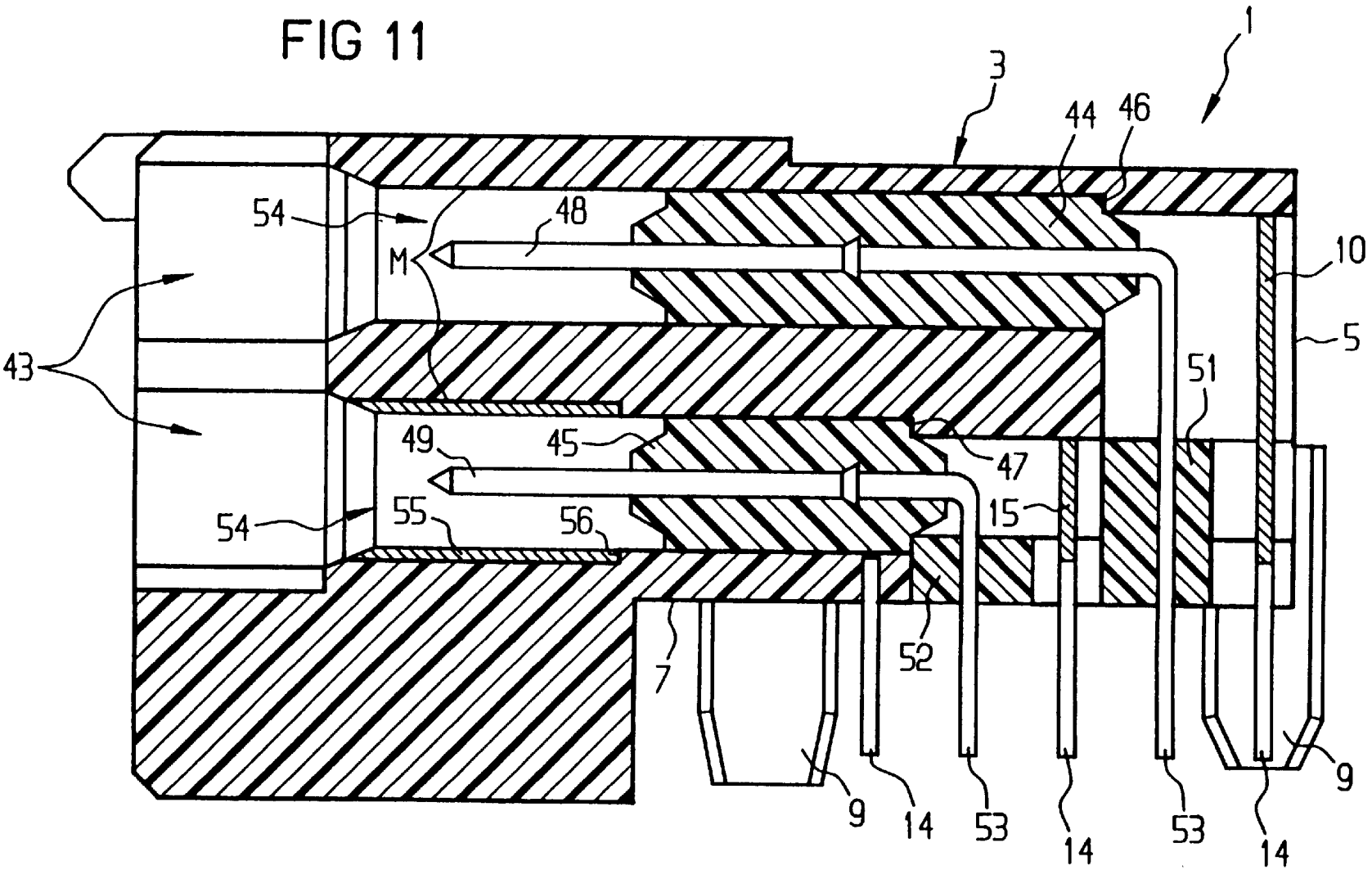
FIG. 11 is a sectional view of the coaxial plug module of FIG. 1.
Figure 12:
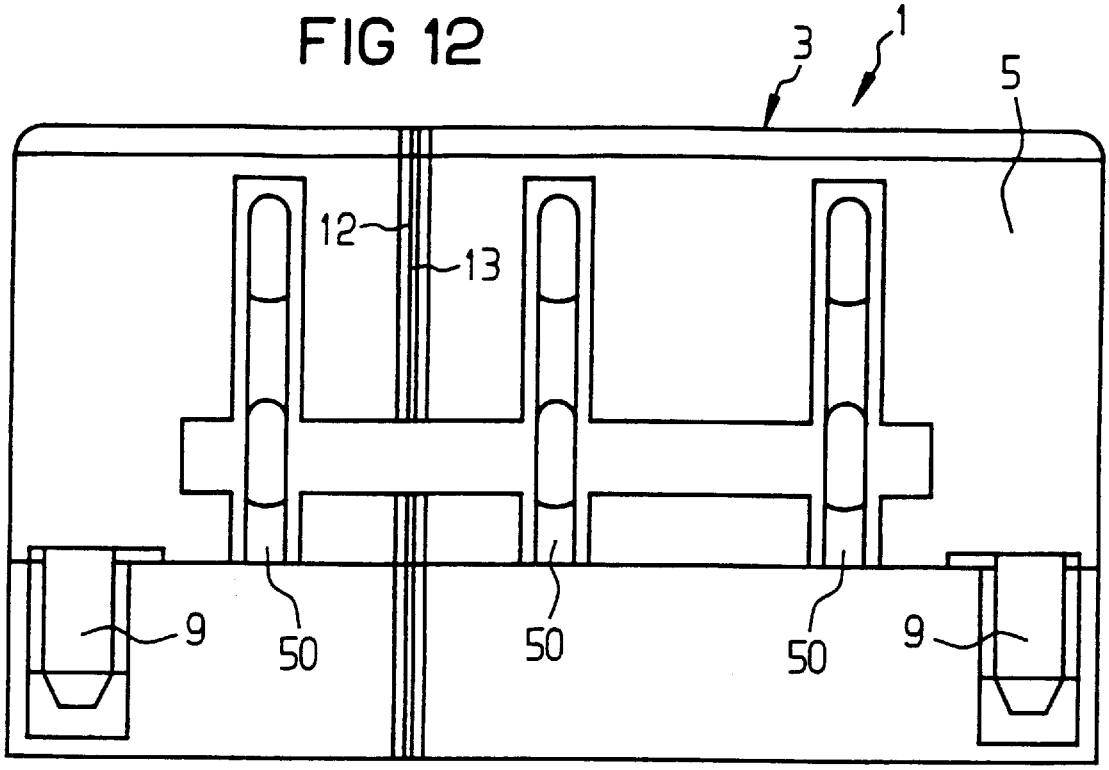
FIG. 12 is an elevation view of the coaxial plug module of FIGS. 1 and 11, showing a back wall.
Figure 13:
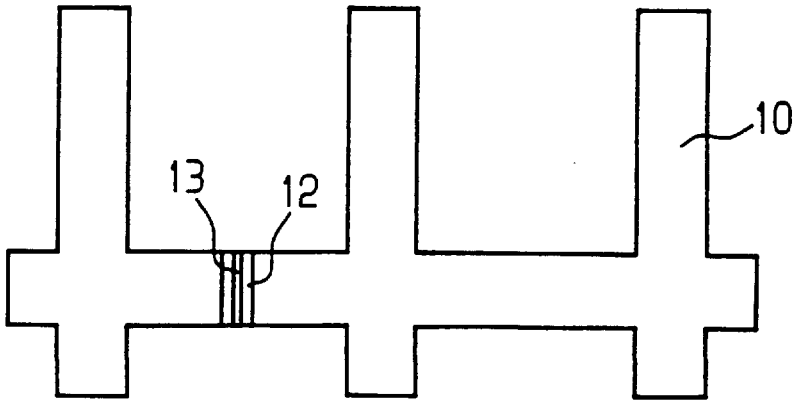
FIG. 13 is an elevation view showing a cap that closes off openings in the back wall of the coaxial plug module of FIG. 12.

FIG. 11 is a sectional view of the coaxial plug module 1 of FIG. 1, which illustrates that in this case as well the coaxial outer conductors are integrated with its housing 3, in the form of bores 43. Insulating plastic sheaths 44 and 45 are thrust into these bores 43 from the front side (insertion side) until they meet respective stops 46 and 47. Angled coaxial inner conductors 48 and 49 that are received within the plastic sheaths 44 and 45 are conversely thrust into the insulating plastic sheaths 44 and 45 from the rear side during assembly. To that end, as FIG. 12 shows, striplike openings 50 are provided in the back wall 5 of the housing 3, and after assembly is concluded these openings are closed by the cap 10 that is common to all of them and is shown in a plan view in FIG. 13. The mounting of the angled coaxial inner conductors 48 and 49 on the housing also requires openings in the bottom 7 of the housing 3, which are not designated by reference numerals in FIG. 11 but are respectively closed off by insulating plastic parts 51 and 52 following the mounting of the coaxial inner conductors 48 and 49. Parts of the angled coaxial inner conductors 48 and 49 that extend out of the bottom 7 are passed through these plastic parts 51 and 52 in the process, as is shown by FIG. 11. In this case, ends of the angled coaxial inner conductors 48 and 49 toward the bottom are shaped by a swaging process to form terminal pins 53. However, as in FIGS. 6, 8 and 10, terminal pins 14 that can also be employed in this case are then press-fitted or soldered into the suitably shaped end surfaces of the coaxial inner conductors on the bottom 7 of the housing 3.

A mutual shielding between coaxial plugs 54, which are disposed one above the other, in the region of the bottom openings that are not identified by reference numerals in FIG. 1 but are required for mounting the angled coaxial inner conductors 48 and 49, can be carried out in a simple way through the use of a ground strip 15 which is shown in FIG. 2 and is equipped with the terminal pins 14. The ground strip 15 is thrust upward from the bottom 7 of the housing 3 in-between the coaxial inner conductors 48 and 49, as FIG. 11 shows. If the bores 43 are to perform the coaxial outer conductor function for the coaxial plugs 54, then they must be provided at their walls with a metallizing M, specifically continuously as far as the metallizing M with the terminal pins 14 on the outside of the bottom 7 of the housing 3. However, it must be noted that in the view of the coaxial plug module 1 shown in FIG. 11, the housing 3 is fully metallized, as in FIG. 1.

In the coaxial plug module 1 of FIGS. 1 and 11 as well, if more stringent demands for quality are made of the coaxial plug connector, it may be appropriate to only partially integrate the coaxial outer conductors with the housing 3 of this coaxial plug connector. In FIG. 11, one such partial integration is shown for the lower coaxial plug 54. In this case, the coaxial outer conductor, which is formed by the bore 43 in the housing 3, is widened in its diameter, in the insertion region, to receive a metal outer conductor tube 55, which is thrust into the bore 43 until it meets a stop 56.

In the exemplary embodiments shown in the drawing, the coaxial plug module 1 is shown as an angled plug connector part, and the coaxial socket module 2 is shown as a straight plug connector part. However, although the invention is described in detail in terms of these exemplary embodiments, it may be achieved in the same way if conversely the coaxial plug module is a straight plug connector part and the coaxial socket module is an angled plug connector part. It is also possible for both plug connector parts to be either straight plug connector parts or angled plug connector parts.

We claim:

1. An HF coaxial connector, comprising:

a coaxial plug module including a multiple plug housing having bores acting as coaxial outer conductors, and coaxial inner conductors having bottom terminal pins disposed and insulated in said bores;

a coaxial socket module including a multiple socket housing having an insertion side for said coaxial plug module, sheaths extended in said housing toward said insertion side, said sheaths having receiving openings and a tubular foot part with a widened outer diameter, conductive coaxial outer conductors at least partially integrated with said housing, insulating plastic sheaths inserted into said coaxial outer conductors, and coaxial inner conductors disposed in said insulating plastic sheaths and having bottom terminal pins disposed in said receiving openings and insulated against said coaxial outer conductors;

said coaxial socket module and said coaxial plug module having an equal number of coaxial plugs and coaxial sockets in the same configuration;

said multiple plug housing of said coaxial plug module and said multiple socket housing of said coaxial socket module being plastic housings at least partially having a metallizing, said metallizing having a layer thickness at least equal to a depth of penetration of electromagnetic waves to be transmitted through the coaxial connector; and each of said coaxial plug module and said coaxial socket module to be secured to a respective base for making a conductive connection between said terminal pins and associated terminals on the respective base.

2. The HF coaxial connector according to claim 1, wherein said base is a printed circuit board, and said outer diameter of said tubular foot part is widened in steps.

3. The HF coaxial connector according to claim 1, wherein said sheaths acting as conductive coaxial outer conductors of said coaxial socket module have a transition to said tubular foot part, a free end surface with an outside, slits extending in axial direction from said free end surface to the vicinity of said transition upon complete integration into said housing, and contact beads on said outside of said free end surface.

4. The HF coaxial connector according to claim 1, wherein said sheaths acting as conductive coaxial outer conductors of said coaxial socket module have an outside, a free end surface, and a metal spring ring with contact beads on said outside, said ring slipped onto said free end surface and connected firmly upon partial integration with said housing.

5. The HF coaxial connector according to claim 1, wherein:

said sheaths acting as conductive coaxial outer conductors of said coaxial socket module use said tubular foot part upon partial integration with said housing and have a free end with a surface, an actual plug part between said free end and said tubular foot part, a metal outer conductor tube pressed onto said insulating plastic sheath, and axial slits on said free end surface forming a radial spring crown;

said radial spring crown has spring blades with free ends having an outside and contact beads on said outside of said free ends; and said insulating plastic sheaths receiving said coaxial inner conductors are inserted together with said metal outer conductor tubes pressed thereon into said tubular foot parts.

6. The HF coaxial connector according to claim 1, wherein said sheaths of said housing in said coaxial socket module acting as conductive coaxial outer conductors have a tubular inside diameter offset at least once in a stepped manner, and said insulating plastic sheaths to be inserted therein have a tubular outside diameter offset at least once in a stepped manner, in each case along their length, forming annular edges acting as mutually associated stops for said insulating plastic sheaths to be thrust into said sheaths until meeting a stop.

7. The HF coaxial connector according to claim 1, wherein said multiple plug housing of said coaxial plug module is an angled coaxial plug connector part.

8. The HF coaxial connector according to claim 1, wherein said multiple plug housing of said coaxial plug module is a straight coaxial plug connector part.

9. The HF coaxial connector according to claim 1, wherein said multiple socket housing of said coaxial socket module is a straight coaxial plug connector part.

10. The HF coaxial connector according to claim 1, wherein said multiple socket housing of said coaxial socket module is an angled coaxial plug connector part.

11. The HF coaxial connector according to claim 1, wherein said terminal pins in said bottom of said housing for said coaxial outer conductors of said coaxial plug module and said coaxial socket module are press-fitted individually into conductive holes in a wall.

12. The HF coaxial connector according to claim 1, wherein said terminal pins in said bottom of said housing for said coaxial outer conductors of said coaxial plug module and said coaxial socket module are secured multiply to ground strips and press-fitted into conductive slots in a wall.

13. The HF coaxial connector according to claim 1, wherein said coaxial plug module is an angled coaxial plug connector part, said housing of said coaxial plug module has striplike openings in a back wall for mounting said angled coaxial inner conductors, and a common cap closes said openings.

14. The HF coaxial connector according to claim 1, wherein said bores acting as coaxial outer conductors in said housing of said coaxial plug module have at least one inner annular edge, said insulating plastic sheaths receiving said coaxial inner conductors have at least one outer annular edge and are thrust from a front side into said bores until meeting a stop, and said coaxial inner conductors of said coaxial plug module are angled and are thrust into said insulating plastic sheaths from a rear side.

15. The HF coaxial plug connector according to claim 1, wherein said bores acting as said coaxial outer conductors in said housing of said coaxial plug module are metal outer conductor tubes in an insertion region of said coaxial plugs, said tubes are inserted from a front side into said bores until meeting a stop, and said bores have a widened diameter therefor in said insertion region.

16. The HF coaxial plug connector according to claim 1, wherein said terminal pins of said coaxial plug module and of said coaxial socket module have press-fit contact heads.

17. The HF coaxial plug connector according to claim 1, wherein:

said housings of said coaxial plug module and said coaxial socket module have an outer wall with at least one groove having an opening and a center rib in said groove acting as a separation lug and not protruding past said opening of said groove;

said coaxial plug module and said coaxial socket module match one another and said at least one groove is disposed between two respective columns or lines of said coaxial plugs and coaxial sockets disposed in a pattern of columns and lines; and a severing created by said groove on said housing of said conductive connection between said coaxial outer conductors of said coaxial plug module and said coaxial socket module is brought about by breaking away said center rib in said groove.

18. The HF coaxial plug connector according to claim 17, wherein at least one of said plastic housing of said coaxial plug module and said plastic housing of said coaxial socket module is completely metallized, and said at least one groove with said center rib in said outer wall of at least one of said housing of said coaxial plug module and said housing of said coaxial socket module annularly encompasses at least one of said housings.

19. The HF coaxial plug connector according to claim 17, wherein at least one of said plastic housing of said coaxial plug module and said plastic housing of said coaxial socket module is covered completely with a metallizing, said metallizing of said housing is present essentially to an extent necessary for electrically conductive properties of said sheaths including said terminal pins in said housing of said coaxial socket module and said bores including said terminal pins in said housing of the coaxial plug module.

20. The HF coaxial plug connector according to claim 17, wherein said severing of said conductive connection between said coaxial outer conductors of said coaxial plugs and coaxial sockets, disposed in a pattern of columns and lines, of said respective coaxial plug module and coaxial socket module, is effected by partial linear removal of said metallizing on said housing, given a matching configuration on said coaxial plug module and said coaxial socket module, between two columns or two lines of said coaxial plugs or coaxial sockets.

21. The HF coaxial plug connector according to claim 20, wherein the partial linear removal is effected by laser machining.

22. The HF coaxial plug connector according to claim 1, wherein said housings of said coaxial plug module and said coaxial socket module are metal housings of die-cast metal.

23. The HF coaxial plug connector according to claim 22, wherein metal housings are formed of die-cast zinc.

24. The HF coaxial connector according to claim 1, wherein at least one of said multiple plug housing and said multiple socket housing includes a protrusion, and the other one of said multiple plug housing and said multiple socket housing is formed with a recess for engaging said protrusion and centering said multiple plug housing with respect to said multiple socket housing.

* * * * *